United States Patent [19]

Thorpe

[11] 4,210,006

[45] Jul. 1, 1980

[54] WASHING MACHINES FOR USE IN THE TEXTILE INDUSTRY

[75] Inventor: Alfred Thorpe, Bramhall, England

[73] Assignee: Sir James Farmer Norton & Co. Limited, Manchester, England

[21] Appl. No.: 20,691

[22] Filed: Mar. 15, 1979

[30] Foreign Application Priority Data

May 25, 1978 [GB] United Kingdom ..... 22568/78

[51] Int. Cl.[2] ..... D06B 1/06

[52] U.S. Cl. ..... 68/205 R

[58] Field of Search ..... 68/62, 181 R, 205 R

[56] References Cited

U.S. PATENT DOCUMENTS 4,095,442 6/1978 Brugman ..... 68/205 R X

*Primary Examiner*—Philip R. Coe

*Attorney, Agent, or Firm*—Sughrue, Rothwell, Mion, Zinn and Macpeak

[57] ABSTRACT

An industrial washing machine has a pair of rows of vertically spaced rotatable rollers for causing fabric to be washed to follow a horizontally sinuous path. Wash water is supplied from above the rollers down onto the fabric. Perforated trays are disposed under certain rollers so that a roller and the perforated tray immediately therebeneath is separated during a washing operation by a run of fabric. The perforated trays are compartmentalized at at least one end with each compartment being bottom perforated and with the bottom perforation of each compartment being staggared inwardly of the tray end relative to the bottom perforation of the corresponding compartment of the tray immediately thereabove so that water passing through each compartment is, where there is no intervening fabric, directed inwardly from the tray ends during its fall until it contacts fabric.

11 Claims, 4 Drawing Figures

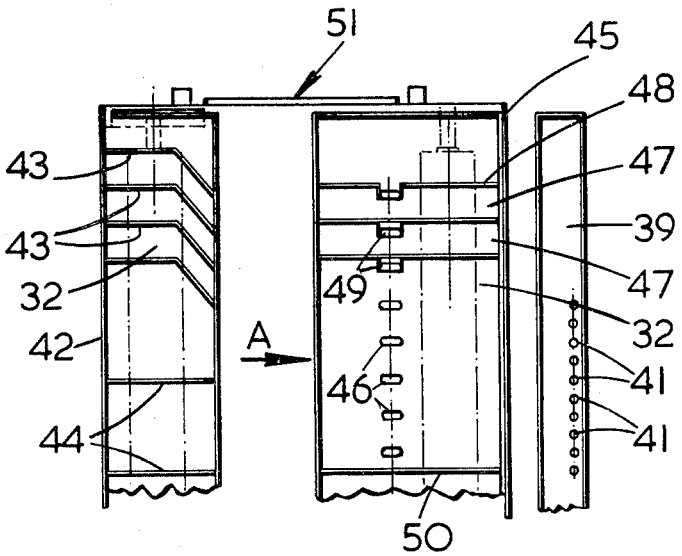
FIG. 3
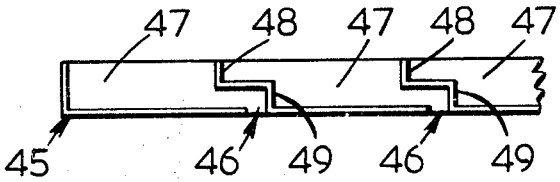

WASHING MACHINES FOR USE IN THE TEXTILE INDUSTRY

BACKGROUND OF THE INVENTION

This invention relates to a washing machine for use in the textile industry, and more particularly to a vertical washing machine of the kind illustrated in FIG. 1 of the drawings.

SUMMARY OF THE INVENTION

It is an object of the present invention to provide a washing machine having simple and efficient means of obviating of mitigating water wastage when fabric lesser than the maximum width is being washed.

According to the present invention there is provided a washing machine comprising a pair of rows of vertically spaced rotatable rollers adapted to constrain fabric to be washed to follow a horizontally sinuous path, a head tank above the rollers for delivering wash water down onto the fabric, and a perforated tray under certain rollers so that a roller and the tray immediately therebeneath are separated during a washing operation by a run of fabric. The trays are compartmentalised at at least one end with each compartment being bottom perforated and with the bottom perforation of each compartment of each tray being staggered inwardly of the tray end relative to the bottom perforation of the corresponding compartment of the tray immediately thereabove so that water passing through each compartment is, where there is no intervening fabric, directed inwardly during its fall until it contacts fabric.

Preferably, an auxiliary tray having a perforated bottom only for a predetermined portion of its length equivalent to the minimum fabric width required to be washed is disposed immediately below the wash water supply means, whereby any wash water passing the first fabric run is caught in the auxiliary tray and directed onto the fabric run immediately therebelow.

Preferably also, the perforated portion of the auxiliary tray length is centrally disposed, the bottom of the auxiliary tray at each end being imperforate.

BRIEF DESCRIPTION OF THE DRAWINGS

In the drawings:

FIG. 3 is a fragmentary plan view of the three kinds of tray used in the present invention.

DETAILED DESCRIPTION OF THE PREFERRED EMBODIMENTS

Figure 1:
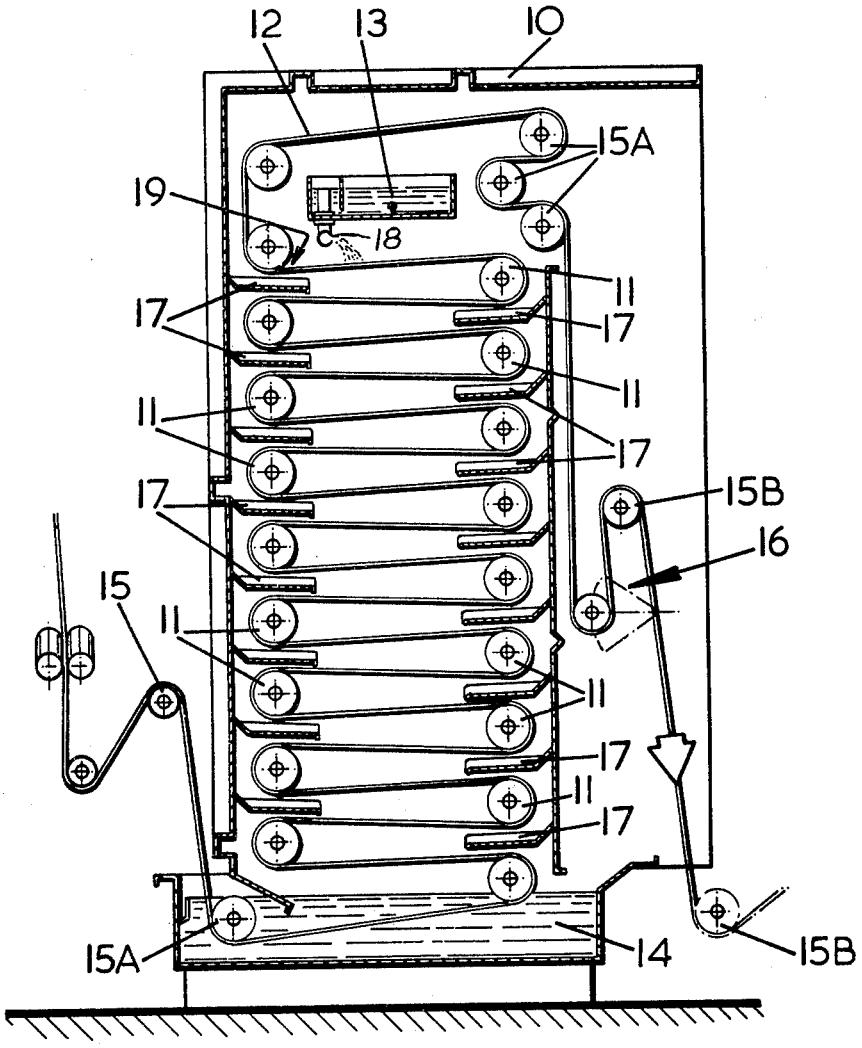
FIG. 1 PRIOR ART
FIG. 1 is a cross-sectional elevation of a prior art vertical washing for textile webs.

Referring to FIG. 1, the prior art washing machine comprises a chamber 10 in which are disposed two main rows of vertically-spaced rollers 11, some driven and some freely rotatable, which constrain fabric 12 to be washed to follow a horizontally sinuous path as shown.

Near the top of the chamber 10 is a head tank 13 from which water, near the boiling point, falls.

At the bottom of the chamber 10 is a collecting bath 14. The washing water falls as well be described later from the head tank 13 down the chamber 10 into the bath, from whence it passes to waste or to the head tank of a preceding machine. Fresh heated water is delivered continuously during a washing operation to the head tank 13.

Entry guide rolls 15, draw rolls 15A and delivery rolls 15B are provided for constraining the fabric 12 to follow the desired path, and a fabric-tensioning arrangement 16 is provided near the chamber exit.

Under each roller 11, except the bottom roller of each row is a perforated tray 17.

In operation, clean washing water falls gravitationally out of the head tank 13 through a perforated pipe 18 in the manner of a heavy rain shower onto the uppermost run of fabric. The water runs down the fabric 12 and forms a wedge at location 19 whereat, due to roller rotation, the water is pressed through the fabric onto the perforated tray 16 immediately below. The water then passes through the perforations in the tray 17 onto the next fabric run where the above action is repeated. In this way, the water passes along each run of fabric, through the fabric onto and through the next tray 17, down each row, and finally into the bath 14.

Thus the cleanest, i.e. the uppermost, fabric portion encounters the cleanest washing water in counterflow.

A certain proportion of water, but not any substantial amount, will, of course, on occasion fall over the tray ends directly to the bath 14.

It wll be manifest that different widths of fabric, generally between 1 and 3 meters, can be washed in the same machine, and also that the lesser the faric width the more the water which will simply pass down directly through the perforated trays 17 without contacting the fabric 12, which is clearly extremely wasteful.

It has been proposed to combat this waste by providing under the trays imperforate slides which can be moved to close off the end perforations of the trays in accordance with the width of fabric to be washed. However, it is considered that such an arrangement has disadvantages, one of which is that if it is desired to wash a run of fabric of lesser width than that washed immediately before, access to the chamber to adjust the slides is prevented until the temperature therein falls substantially. Another disadvantage is likely to be that link and other textile debris will lodge between the trays and slides interfering with easy and efficient operation of the latter.

Figure 2:
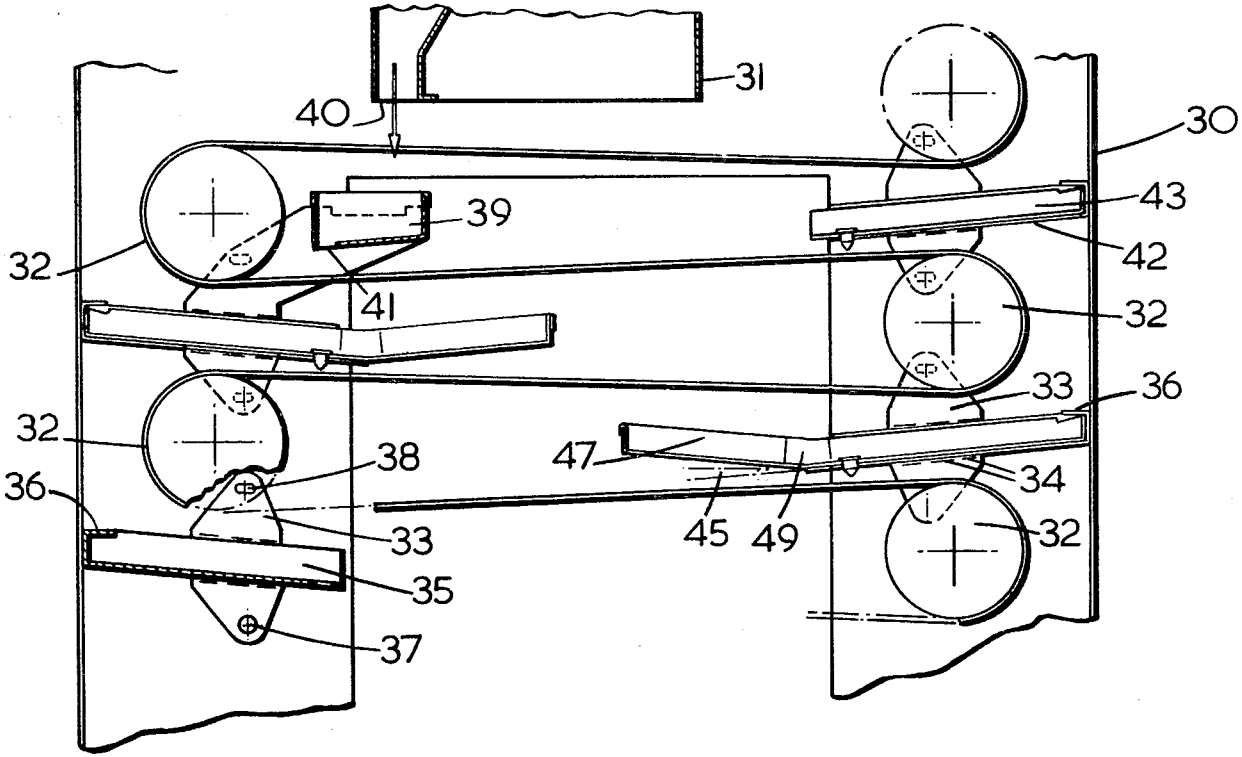
FIG. 2 is a diagrammatic view of the roller/tray combinations of the present invention.

Referring now to FIG. 2, the washing machine chamber is indicated at 30, the head tank at 31 and each roller at 32.

Mounted on each end wall of the chamber 30 are brackets 33, each of which has inwardly directed vertically spaced flanges 34 between which is supported an L-shaped tray support 35 having a back lip 36 which overhangs a tray, when in position, to prevent tipping of the latter.

The brackets 33 are bolted as indicated at 37 to the end walls, the bolts passing elongate screw holes 38 in the bearings of the rollers 32.

There are three kinds of trays employed in the washing machine according to the present invention.

Firstly, there is a single auxiliary tray 39 located directly below the outlet 40 of the head tank 31. This auxiliary tray 39 is bottom perforated inwardly of its ends by a series of holes 41 (see FIG. 3 in particular). Assuming, the maximum width of the fabric which can be washed in the machine is 300 cms, then the central 100 cm length of the auxiliary tray 39 is perforated. The perforated length of this tray is determined by the minimum width of fabric which would be washed in the machine.

The second kind of tray 42 is a short tray which is only employed at locations where difficulty would be encountered when threading the fabric through the machine. Such a tray 42 is not bottom perforated but is inclined as can be seen in FIG. 2 so that water falling onto same runs off the lower edge onto the fabric or a lower tray if no fabric run intervenes. Each end of each tray 42 is compartmentalised by a number of upstanding walls 43 which at their free ends are cranked inwardly of the end of the tray for the purpose to be described later. The middle 100 cm length of the tray 42 lies between the two sets of cranked walls 43 and this middle length is subdivided into compartments by straight walls 44.

The third kind of tray 45 is a long tray and is that most commonly used in the machine. It is of very shallow V-shape in end view with one limb longer than the other and with elongate slots 46 in its bottom at the limbs junction. Each end of each tray 45 is compartmentalsed into the relative narrow compartments 47 by walls 48, each of which has at the limbs junction a box-like extension 49 overlying the adjacent slot 46 of the compartment. The tray 45 looking in the direction of arrow A is illustrated in the lower half of FIG. 3. The central portion of the tray 45 is compartmentalised by walls 50.

Figure 4:
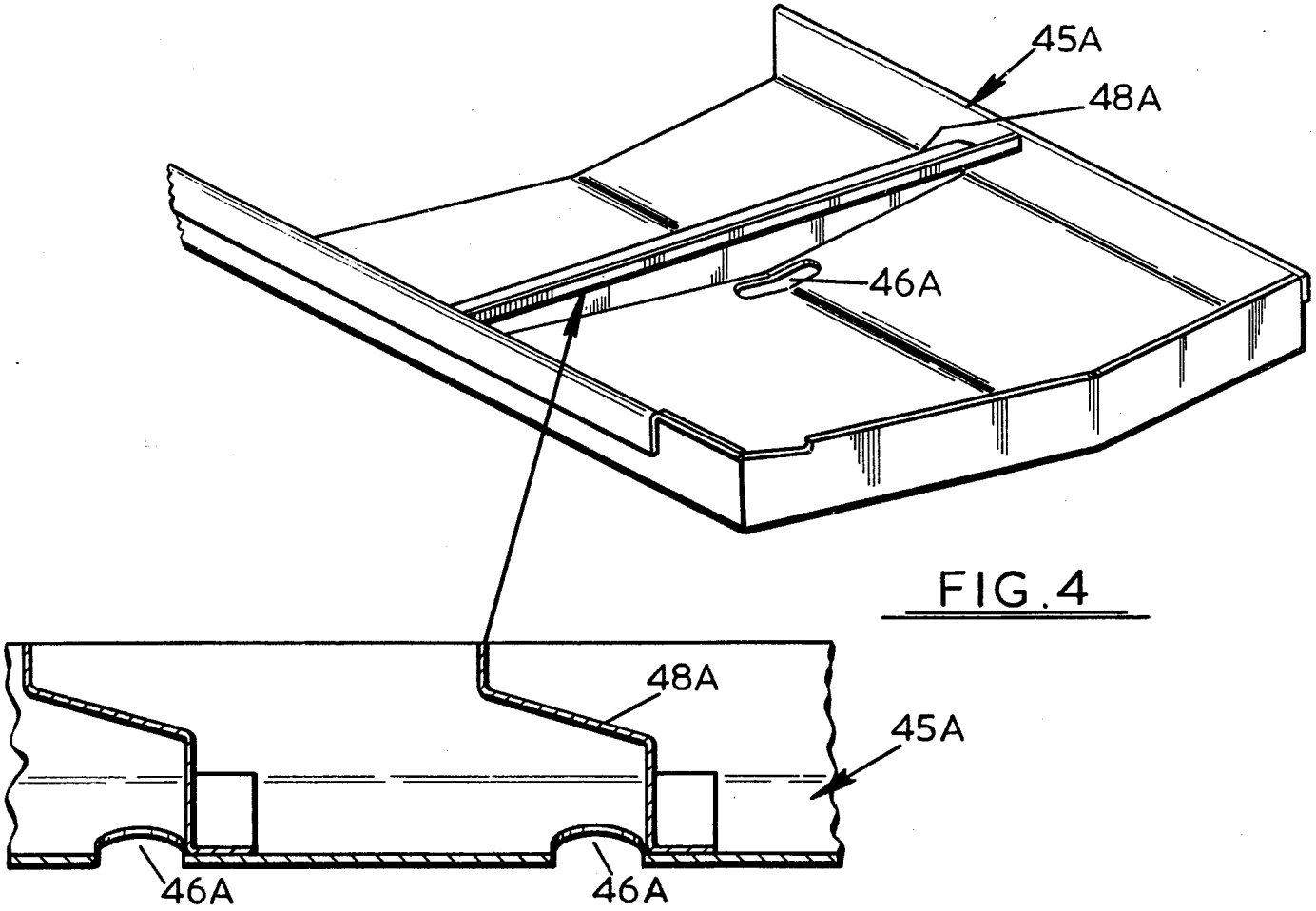
FIG. 4 is a perspective view of a preferred construction of perforated tray.

A preferred construction of long tray 45A is illustrated in FIG. 4, and is compartmentalised by walls 48A extending across the full width thereof and being of a sloping cranked construction. The elongate slots 46A are central of and lie under the cranked walls 48A. Otherwise trays 45A are the same as trays 45.

The access door into the chamber 30 for removal of the trays for cleaning purposes as indicated at 51.

If a full width of cloth is being washed than the washing action is as described with reference to FIG. 1.

If, however, less than a full width of fabric is to be washed, say fabric 150 cm in width, then end areas of the trays 39, 42 and 45 will not have intervening fabric between them and the rollers 32 immediately thereabove.

In this case, some wash water will pass the edges of the uppermost run of fabric into the imperforate areas of the auxiliary tray 39 and from there towards the perforated central area of same and through the perforations onto the fabric run immediately below the auxiliary tray 39. The remainder of the wash water from the head tank 31 will contact the uppermost run of fabric and pass towards uppermost roller 32 whereat it will, as aforesaid, be pressured therethrough onto the short tray 43 immediately therebelow and thence onto the run of fabric immediately below the auxiliary tray 39. Thus, the auxiliary tray 39 ensures, for short width fabrics, an almost immediate contact of wash water and fabric. Due to the cranked nature of the walls 43 the wash water falling onto the tray 42 is given an inward component of movement at the same time. If, as is possible but not desirable, the auxiliary tray 39 were omitted, then wash water, where the fabric to be washed is less then full width, will follow the uppermost fabric run/imperforate tray 43 path as aforesaid. However, wash water will also pass the edges of the fabric into the perforated end compartments 47 of the uppermost tray 45 immediately below the head tank 31. Wash water received in the end compartments 47 of tray 45, due to the lateral disposition of slots 46, does not fall straight down into the corresponding compartment 47 of the tray 45 immediately therebelow but into the compartment inboard of said corresponding compartment.

In this way, wash water which does not fall directly on a fabric run is moved, during its fall, inwardly of the ends of the trays 45 until contact is made with a fabric run. This instant of contact is determined by the width of the fabric being washed.

It is to be clearly understood that the tray and fabric dimensions given above are only by way of example. The term "fabric" used herein and in the claims is intended to include any material capable of being washed in a washing machine as described whatever the form of the material, for example, woven, non-woven or knitted, inter alia.

It will be manifest that if it is desired to wash a run of fabric of lesser width than the immediatley preceding run then entry into the chamber which has a temperature approaching boiling point is not necessary, the loading end of the following run merely being secured in conventional manner to the trailing end of the preceding run.

As there are no movable components associated with the trays no jamming will result nor will there be any excessive build-up of lint or other textile debris. Removal and replacement of the trays for cleaning is simple.

What is claimed is:

1. A washing machine including a pair of rows of vertically-spaced rotatable rollers adapted to constrain a web of fabric to be washed to follow a horizontally sinuous path, wash water supply means above the rollers for delivering wash water down onto the fabric, and perforated trays under certain rollers so that a roller and the perforated tray immediately therebeneath is separated during a washing operation by a run of fabric, characterised by: the perforated trays being compartmentalised at at least one transverse end thereof with the bottom of each compartment being perforated, the bottom perforation of each compartment being spaced inwardly from said one end of the tray relative to the bottom perforation of a corresponding compartment of a tray immediately thereabove, whereby water passing through each compartment, where there is no intervening fabric, flows inwardly in a stepwise manner from said one ends during its fall until it contacts fabric.

2. A washing machine is claimed in claim 1, comprising an auxiliary tray having a perforated bottom only for a predetermined portion of its length equivalent to the minumum fabric width required to be washed disposed immediately below the wash water supply means, whereby any wash water passing the first fabric run is caught in the auxiliary tray and directed onto the fabric run immediately therebelow.

3. A washing machine as claimed in claim 2, in which the perforated portion of the auxiliary tray length is centrally disposed, the bottom of the auxiliary tray at its opposite transverse ends being imperforate.

4. A washing machine as claimed in any one of the preceding claims comprising, at predetermined locations, wash water receiving trays of non-perforated construction inclined so as to allow wash water to run down towards the centre of the machine onto a fabric run or a lower perforated tray.

5. A washing machine as claimed in claim 4, in which each non-perforated tray is, at least at one transverse end thereof, compartmentalised by upstanding walls having free end portions cranked inwardly of said one end.

6. A washing machine as claimed in claim 5, in which the opposite transverse ends of each perforated tray are compartmentalised.

7. A washing machine as claimed in claim 6, in which the opposite transverse ends of each non-perforated tray are compartmentalised by upstanding inwardly cranked walls.

8. A washing machine as claimed in claim 7, in which each perforated tray has a shallow V-configuration in end view with one limb longer than the other and an elongate slot at the limb junction.

9. A washing machine as claimed in claim 8, in which the opposite transverse ends of each perforated tray are compartmentalized by upstanding walls each having laterally offset from one end of the tray a box-like structure overlying the slot in said compartment.

10. A washing machine as claimed in claim 8, in which each perforated tray is compartmentalised by upstanding transverse walls of cranked construction overlying the slots.

11. A washing machine as claimed in claim 1, comprising tray mountings comprising end wall brackets with inwardly-directed top and bottom tray-holding flanges and a back non-tip lip which overlies an associated tray, which mountings enable easy tray removal for cleaning.

* * * * *